United States Patent [19]

Kuber

[11] Patent Number: 4,838,243

[45] Date of Patent: Jun. 13, 1989

[54] CHIMNEY CLEANOUT TEE CAP LOCK

[76] Inventor: Stephen Kuber, 52 Cumberland Dr., Brick Town, N.J. 08723

[21] Appl. No.: 39,330

[22] Filed: Apr. 17, 1987

[51] Int. Cl.[4] ..... F24C 15/14

[52] U.S. Cl. ..... 126/280; 126/307 R; 292/259 R; 292/DIG. 60

[58] Field of Search ..... 126/16, 242, 280, 307 R; 16/222; 292/95, 101, 259, DIG. 60; 49/463

[56] References Cited

U.S. PATENT DOCUMENTS

| | | | |
|---|---|---|---|
| 95,146 | 9/1869 | Sage | 292/95 |
| 248,397 | 10/1881 | Brauy | 126/280 |
| 509,626 | 11/1893 | Patterson | 49/463 X |
| 521,870 | 6/1894 | Smith | 292/259 |
| 741,721 | 10/1903 | Rumford | 49/463 X. |
| 1,060,484 | 4/1913 | Newton | 292/DIG. 60 |
| 1,615,909 | 2/1927 | Hance | 126/307 R |
| 1,943,973 | 1/1934 | Jamias | 292/95 X |
| 2,175,564 | 10/1939 | Ingham | 126/280 X |
| 3,773,029 | 11/1973 | Kent | 126/288 |

FOREIGN PATENT DOCUMENTS

| | | | |
|---|---|---|---|
| 387278 | 2/1933 | United Kingdom | 292/95 |

*Primary Examiner*—Harold Joyce
*Attorney, Agent, or Firm*—Clifford G. Frayne

[57] ABSTRACT

A chimney lock attachable to the support plate of a prefabricated metal chimney having vertically downwardly depending cleanouts, the cleanouts being enclosed by an end cap, the lock comprising an adjustable, planer, longitudinal bar removably or rotatably secured to the support plate and positioned to frictionally engage and secure the end cap of the chimney cleanout.

2 Claims, 2 Drawing Sheets

CHIMNEY CLEANOUT TEE CAP LOCK

FIELD OF THE INVENTION

The present invention relates to chimneys and, in particular, to prefabricated metal chimneys normally accessible by a cleanout tee, the cleanout tee having a frictionally engaged cap or plug or cap secured by set screws.

BACKGROUND OF THE INVENTION

In the construction industry, particularly with single family homes, townhouses and condominiums, there has been increasing use of factory-built, prefabricated metal chimneys for use with interior fireplaces, wood stoves, and even with normal gas furnaces. These chimneys vent the spent gas from the fireplace, stove or furnace to the atmosphere normally at a legislated height above the roof of the residence.

Depending on the location of the fireplace, stove or furnace, these chimneys may extend substantially horizontally through a sidewall of the dwelling before extending substantially longitudinally perpendicularly along the outside wall of the dwelling to the predetermined height or they may extend through an interior wall of the dwelling into a utility room or attached garage before extending substantially longitudinally vertically through the roof of the dwelling with a substantial portion of the vertical portion of the chimney within the dwelling itself.

In either instance, it is normal procedure to support the vertical portion of the chimney with a support plate which is proximate to the position where the chimney changes direction from the horizontal to the vertical. It is also normal practice in the industry to provide for a cap or plug on the lower portion of the vertical section of a chimney known as the cleanout tee to facilitate the removal of accumulated soot and debris on a regular basis. Normal procedure is for either a frictionally-engaged end cap or plug or a cap secured by circumferential set screws to be placed at the bottom of the vertical section of the chimney, below the horizontal portion. This cap can be removed and soot and other accumulated debris can be cleaned out or can fall naturally under the influence or gravity to a container for removal.

Since the combustion process generates corrosive gases, these end caps, and in particular, the screws which secure them, deteriorate to the point where the screws rust permitting the end cap to fall off or the end cap itself deteriorates such that the end cap is capable of falling out.

If the end cap were to fall out, the homeowner is faced with the consequences of having possible noxious and toxic fumes exit the chimney within the dwelling place and may quite possibly subject the dwelling to a fire hazard as a result of this cleanout tee being located proximate to the fireplace, stove or furnace such that hot gases would exit the cleanout tee and ignite flammable material proximate to the chimney which could include the exterior sidewall of the dwelling unit if the design of the chimney were such that the vertical section was located parallel to the sidewall. There have, in fact, been reported cases of fires as a result of the deterioration of the end caps.

The Applicant's invention relates to a locking bar secured to the support plate and designed to frictionally engage the bottom of the end cap to prevent its inadvertent release from the chimney. Regular inspection of the end cap is still required to determine deterioration of the end cap, but Applicant's invention prohibits inadvertent removal of the end cap regardless of deterioration.

OBJECTS OF THE INVENTION

An object of the present invention is to provide a novel chimney end cap lock for attachment to the support plate of a metal chimney to secure the end cap.

A further object of the present invention is to provide a novel chimney end cap lock for attachment to support plate of a metal chimney to frictionally engage the chimney end cap and prevent its inadvertent removal and at the same time be easily rotatable or removable so as to permit inspection of the end cap and cleaning of the chimney.

A still further object of the present invention is to provide a novel chimney end cap lock for attachment to a metal chimney which is easily adjustable to fit metal chimneys of varying diameters and to retain the chimney end cap in position.

SUMMARY OF THE INVENTION

These and other objects of the present invention are achieved by a removably secured lock bar or in the alternative, a rotatably secured lock bar, secured to the underside of the chimney support plate and positioned to frictionally engage and secure the cleanout tee end cap in position.

BRIEF DESCRIPTION OF THE DRAWINGS

A better understanding of the present invention as well as other objects and advantages thereof will become apparent upon consideration of the detailed disclosures thereof, especially when taken with the accompanying drawings wherein.

DETAILED DESCRIPTION OF THE DRAWINGS

Figure 1:
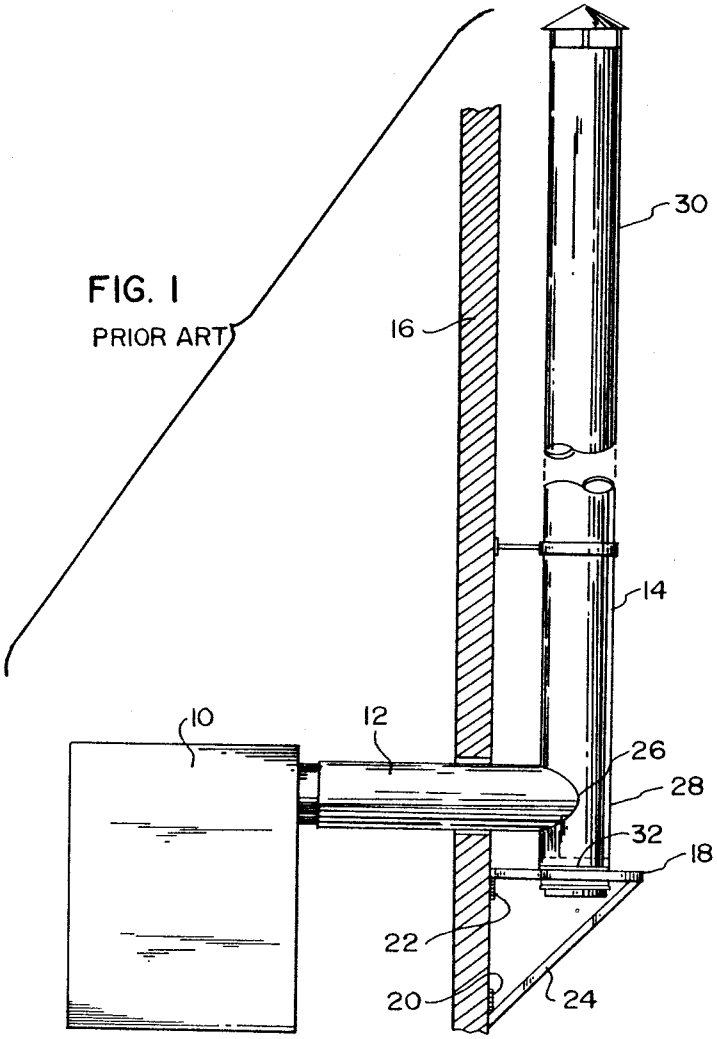
FIG. 1 PRIOR ART
FIG. 1 is a side, elevational, schematic view of a typical prefabricated chimney mounted to the exterior wall of the building.

Referring to FIG. 1, there is shown a schematic of a prefabricated metal chimney secured to a heating unit and extending through the exterior wall of a building.

The heating unit 10, be it a wood stove, fireplace or gas furnace, has a substantially horizontal outlet conduit 12 for the communication and transfer of flue gases away from the furnace. Conduit 12 is in communication with a vertical conduit 14 which vents the flue gases to the atmosphere. Horizontal conduit 12 extends through wall 16 of the dwelling unit or building and vertical conduit 14 is secured to the exterior of wall 16.

In normal operation, vertical conduit 14 is positioned and braced by a support plate 18 which has a circular opening 19 positioned therethrough, support plate 18 is secured to the exterior of wall 16 by securing means 22 and 20 with an angled support bar 24 extending upwardly from anchor point 20 to support plate 18. Support plate 18 provides a substantially planer surface to support vertical conduit 14. Horizontal conduit 12 and vertical conduit 14 of the prefabricated chimney intersect to form a T-shaped junction 26 dividing vertical conduit 14 into a downwardly extending vertical portion 28 which rests upon support plate 18, and an upwardly extending end 30 to permit the venting of flue gases to the atmosphere and may contain a cone-shaped shield or deflector to prevent leaves and other debris from entering downwardly into conduit 14.

Figure 2:
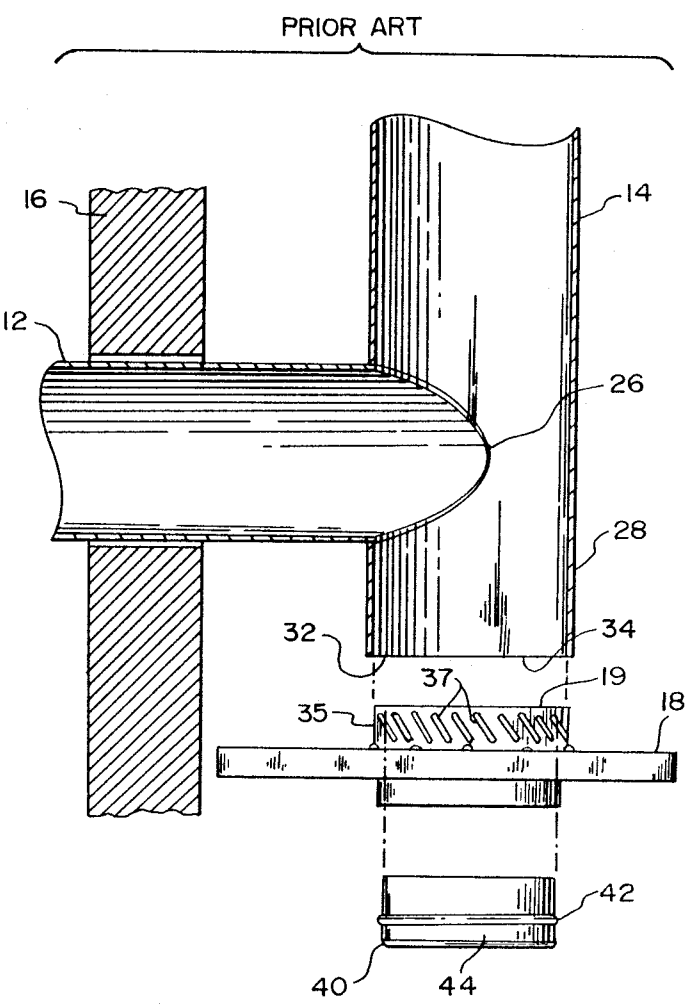
FIG. 2 PRIOR ART
FIG. 2 is an exploded side elevational view of a typical cleanout tee and end cap assembly.

Referring to FIG. 2, the lower end 32 of conduit 14 has a circular opening 34. Lower end 32 of conduit 14 is designed to be secured to support plate 18. This can be by a variety of means, but the normal industry standard is for an annular collar 35 to be secured to support plate 18 by spot welding. Annular collar 35 extends upwardly and downwardly from support plate 18 and is coincidental with opening 19 of support plate 18. The upwardly extending portion of annular collar 35 has a plurality of angled ridges 37 to permit vertical conduit 14 to be twist secured to annular collar 35. The downwardly extending portion of annular collar 35 is designed to receive a removable end cap 40. Removable end cap 40 permits the owner or maintenance people to clean out debris and soot which may accumulate in lower portion 28 of vertical conduit 14.

End cap 40 is designed to conform to the opening in the downwardly extending portion of annular collar 35. End cap 40 is normally circular in cross sectional area and is of a plug like design having an annular circumferential ring 42 extending outwardly from circumferential sidewall 44 to frictionally engage the interior surface of annular collar 35. An alternate method of securing end cap 40 is for end cap 40 to have an upwardly extending circumferential sidewall which would frictionally engage the outer sidewall of the downwardly depending portion of annular collar 35 and maintained in position by set screws.

Due to the composition and makeup of flue gases, end cap 40 or the means for securing end cap 40 to annular collar 35 thus sealing conduit 14 oftentimes deteriorates such that end cap 40 under the influence of gravity and as a result of the deterioration due to the composition of the flue gases becomes unsecured to vertical conduit 14.

If end cap 40 were to be removed from cap 40 from conduit 14, a hazardous situation develops whereby hot venting flue gases taking the path of least resistance, would exit lower portion 32 of conduit 14 proximate to wall 16 of the dwelling unit. In design, upper end 30 of vertical conduit 14 is designed to extend above the roof level to a degree significant enough to permit the flue gases to be vented to the ambient atmosphere a sufficient distance from the dwelling unit. With the inadvertent removal of end cap 40, these flue gases are suddently vented to the ambient atmosphere in close proximity to wall 16 and depending upon the construction of wall 16, could provide a significant fire hazard to the dwelling.

Referring to FIG. 2, there is shown a schematic of the prefabricated metal chimney showing an exploded view of end cap 40 as secured to annular collar 35 and vertical conduit 14, while vertical conduit 14 is supported by support plate 18 having substantially planer surface with an opening 19 in alignment with opening 34 and lower portion 28 of conduit 14 and annular collar 35.

Figure 3:
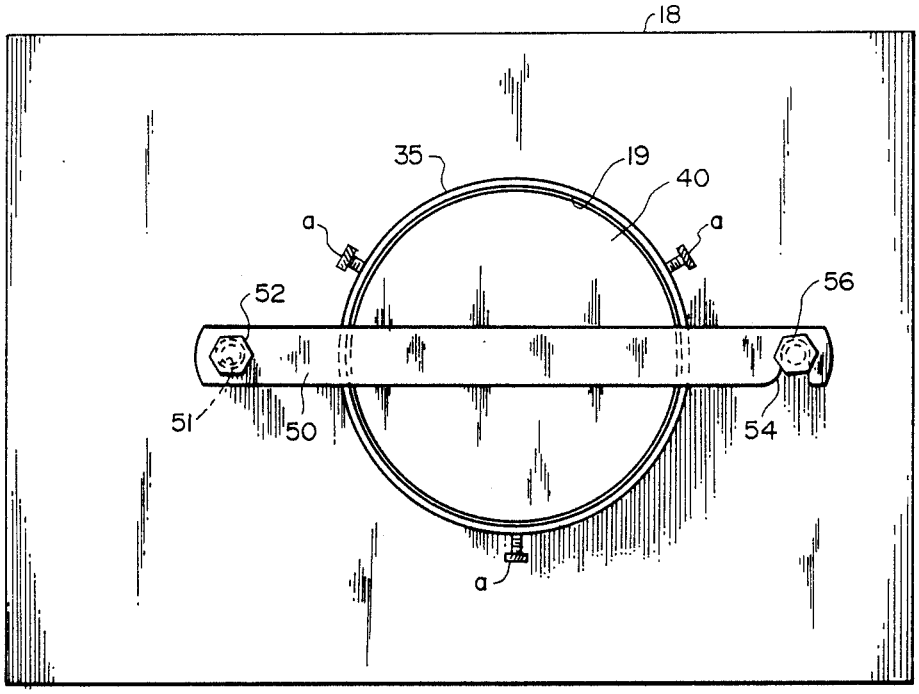
FIG. 3 is a planer bottom view of a support plate with a first embodiment of the locking bar.

Referring to FIG. 3, there is shown a lower bottom planer view of support plate 18 having a first embodiment of the invention secured thereto. In this view, end cap 40 is frictionally engaged to annular collar 35 and conduit 14 and conduit 14 is supported by support plate 18. It should be noted that an alternative securing means for end cap 40 would require end cap 40 to fit over the outer diameter of the downwardly depending portion of annular collar 35 and be frictionally secured by a series of set screws (a) positioned about the circumference. Applicant's invention has application to either of these means of securing end cap 40 to vertical conduit 14. Referring back to FIG. 3, there can be seen lock bar 50 positioned transversely across end cap 40. Lock bar 50 has a securing means 52 proximate to one transverse end thereof permitting the rotation of lock bar 50 about securing means 52. This securing means extends through opening 51 in lock bar 50 which is in alignment with an opening in support plate 18. Proximate to the opposite transverse end of lock bar 50 is a U-shaped notch 54 for frictional engagement with a second securing means 56 again positioned proximate to opposite transverse end of lock bar 50, both securing means 52 and 56 being secured through planer surface of support plate 18. In this configuration as shown in FIG. 3, lock bar 50 is rotated about the securing means 52 to permit the insertion of end cap 40 into the opening of annular collar 35 thus sealing the lower opening 34 of vertical conduit 14. Lock bar 50 is then rotated in the opposite direction such that U-shaped notch 54 engages securing means 56. In this configuration, planer surface of lock bar 50 will be an engagement with the bottom portion of end cap 40 to maintain end cap 40 in position to seal vertical conduit 14. If additional frictional engagement is required, securing means 52 and 56 may be further tightened once lock bar 50 is positioned transversely across end cap 40 to further ensure the security of end cap 40 in opening 34.

Figure 4:
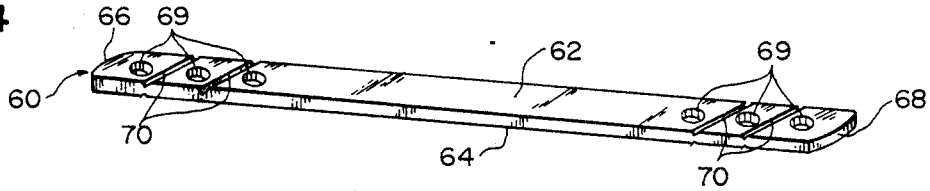
FIG. 4 is a planer top view of a second embodiment of the lock bar.

Referring to FIG. 4, there is shown a second embodiment identified as lock bar 60. It can be seen that lock bar 60 is generally longitudinal in shape having a planer upper surface 62 and planer lower surface 64 and having a first transverse end 66 and a second transverse end 68. Proximate to transverse ends 66 and 68 and in alignment with the axis of lock bar 60 are a plurality of openings 69 located proximate to the transverse ends. Located perpendicular to the axis of lock bar 60 and positioned between plurality of openings 69 are a series of serrated grooves 70. Lock bar 60 is designed to be manufactured to accommodate vertical conduits 14 and annular collars 35 having various diameters. Serrated grooves 70 are designed to permit the owner or installer, to decrease the transverse length of lock bar 60 by breaking off ends to arrive at the appropriate length such that any two of the plurality of openings 69 can be made to coincide with openings in support plate 18 in order to affix lock bar 60 in position to secure end cap 40 in annular collar 35 to seal vertical conduit 14. In this configuration, rather than having one end of lock bar 60 rotatably secured with the other end having a U-shaped notch such as in the first embodiment, this embodiment envisions lock bar 60 being secured by nut or bolt or similar securing means directly to support plate 18. In such a configuration, both of the securing means of lock bar 60 would have to loosened and at least one removed to permit the rotation of lock bar 60 in order to remove end cap 40 to remove soot and other debris from lower portion 28 of vertical conduit 14.

Figure 5:
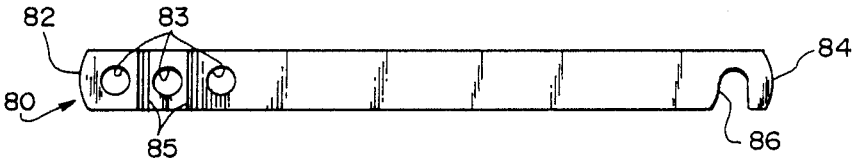
FIG. 5 is a planer top view of a third embodiment of the invention.

Referring to FIG. 5, there is shown a third embodiment of the present invention identified as lock bar 80. Lock bar 80 is substantially identical to the first embodiment of the invention, lock bar 80 being substantially planer and having a first transverse end 82 and a second transverse end 84. First transverse end 82 has positioned proximate thereto in alignment with the longitudinal axis of lock bar 80, a plurality of openings 83. Positioned perpendicular to the axis of lock bar 80 and between the plurality of openings 83 are a series of serrated grooves 85 which are designed to permit the owner or installer to decrease the transverse length of lock bar 80. Proximate to second transverse end 84 of lock bar 80 is U-shaped notch 86. This third embodiment of the present invention functions identically the same as the first embodiment of the invention with the exception that the plurality of openings 83 located proximate to first transverse end 82 and serrated grooves 85 permit the owner or maintenance man to adjust the length of lock bar 80 to accommodate chimneys and end caps of varying diameters.

Figure 6:
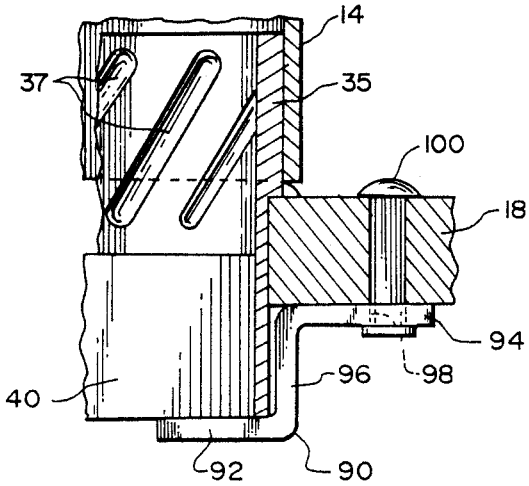
FIG. 6 is a side elevational view of a fourth embodiment of the invention secured to the support plate.

Referring to FIG. 6, there is shown a fourth embodiment of the present invention. FIG. 6 is a cutaway side elevational view showing support plate 18 having annular collar 35 positioned through opening 19 in support plate 18 and showing end cap 40 positioned in the downwardly extending portion of annular collar 35. The fourth embodiment of the invention encompasses a Z-shaped bracket 90 having horizontal legs 92 and 94 and vertical leg 96. Horizontal leg 94 has an opening 98 therethrough in alignment with an identical opening in support plate 18 for the receipt of a securing means 100. As shown in FIG. 6, in this configuration, Z-shaped bracket 90 is secured to support plate 18 such that horizontal leg 92 extends under end cap 40 so as to maintain end cap 40 in position in annular collar 35. In this embodiment, several Z-shaped brackets would be utilized around the circumference of annular collar 35 in order to maintain end cap 40 in position.

The embodiments of Applicant's invention provide for an apparatus which will maintain the end cap of a prefabricated metal chimney in position. Further, Applicant's embodiments provide for a securing means which is secured to the support plate of such a chimney and somewhat distantly removed from the chimney such that the caustic gases and heat from the chimney will not have a deteriorating effect on the apparatus. This does not prevent the deterioration of the end cap itself, but ensures that the end cap will not inadvertently be removed from the chimney. Further, Applicant's apparatus can be made of any suitable material which will not be overly susceptible to weather conditions and the apparatus can be installed simultaneously with the installation of the chimney yet requires little modification of the chimney such that it is easily installable on existing chimneys.

It will be recognized by those skilled in the art that the apparatus has been described in connection with the exemplary embodiments thereof and it will be understood that many modifications will be apparent to those of ordinary skill in the art that this application is intended to cover any adaptations or variations thereof. Therefore, it is manifestly intended that thsi invention be only limited by the claims and the equivalents thereof.

I claim:

1. A chimney lock removably attachable to the support plate of prefabricated chimneys, said chimneys having vertically downwardly depending cleanouts, said cleanouts being enclosed by an end cap, said end cap frictionally engaged in said downwardly depending cleanout, comprising:

a planer longitudinal bar having a first transverse end and a second transverse end, said first transverse end having a plurality of longitudinally aligned apertures, said longitudinally aligned apertures having alternately positioned therebetween, a plurality of serrated grooves permitting the selective adjustment of the length of said longitudinal bar to accommodate said cleanouts and said end caps of varying diameters, a U-shaped notch positioned proximate to said second transverse end of said longitudinal bar, securing means, comprising a first and a second downwardly depending threaded fastener, said first downwardly depending threaded fastener for engaging said apertures proximate to said first transverse end of said longitudinal bar, said second downwardly depending threaded fastener for engaging said U-shaped notch proximate to said second transverse end of said longitudinal bar, said downwardly depending fasteners positioned downwardly from said support plate permitting the rotation of said longitudinal bar about first threaded fastener so as to permit said U-shaped notch to engage said second downwardly depending threaded fastener.

2. A chimney lock removably attachable to the support plate of prefabricated chimneys, said chimneys having vertically downwardly depending cleanout, said cleanout being enclosed by an end cap, said end cap frictionally engaged in said downwardly depending cleanout, comprising:

a planer longitudinal bar having a first transverse end and a second transverse end, said first transverse end having a plurality of longitudinally aligned apertures, said longitudinally aligned apertures having alternately positioned therebetween, a plurality of serrated grooves permitting the selective adjustment of the length of said longitudinal bar to accommodate said cleanouts and end caps of varying diameters, said second transverse end having an aperture positioned proximate thereto, securing means, comprising a first and second downwardly depending threaded fastener, said first downwardly depending threaded fastener for engaging a selective aperture proximate to said first transverse end of said longitudinal bar, said second downwardly depending threaded fastener for engaging said aperture proximate to said second transverse longitudinal bar, said downwardly depending fasteners positioned downwardly from said support plate permitting said planer longitudinal bar to be secured to said downwardly depending threaded fasteners and secure said end cap in position.

* * * * *